United States Patent [19]

Kindsfather

[11] 4,227,467

[45] Oct. 14, 1980

[54] TRAY ASSEMBLY

[76] Inventor: Gerald N. Kindsfather, 635 Custer Ave., Billings, Mont. 59101

[21] Appl. No.: 23,665

[22] Filed: Mar. 26, 1979

[51] Int. Cl.[3] ..... A47B 13/14

[52] U.S. Cl. ..... 108/101; 108/90

[58] Field of Search ..... 108/101, 97, 150, 90; 248/158, 188

[56] References Cited

U.S. PATENT DOCUMENTS

| | | | |
|---|---|---|---|
| 636,573 | 11/1899 | Sitts | 108/101 |
| 956,705 | 5/1910 | Hofacker | 108/97 |
| 1,183,114 | 5/1916 | Ramsell et al. | 108/101 X |
| 1,961,502 | 6/1934 | Marengo | 108/101 |
| 3,175,794 | 3/1965 | Beene | 248/188 |

*Primary Examiner*—Francis K. Zugel
*Attorney, Agent, or Firm*—Arthur L. Urban

[57] ABSTRACT

A tray assembly including a tray member and a support member; the support member including a spacer portion having one end affixed to a top of a table and extending upwardly therefrom, and a tray supporting portion at the free upper end of the spacer portion; the tray member including a substantially flat upper tray portion, and a support portion associated with the bottom thereof, the support portion of the tray member including an open central section engageable with the tray supporting portion of the support member to provide a rigid connection therebetween.

2 Claims, 4 Drawing Figures

TRAY ASSEMBLY

This invention relates to a novel tray assembly and more particularly relates to a new tray and table combination.

One of the problems in eating in restaurants, cafeterias and other public eating establishments is having enough table space so that eating of the food may be enjoyed. Generally, public eating places attempt to provide eating space for a maximum number of diners with the result that each table is of minimum size.

The problem of adequate eating space is compounded by the number of articles that are present on the table. Not only are there the plates and other dishes on which the food is served, but also there are the standard articles that are found on most restaurant tables. For example, there are salt and pepper shakers, sauce containers and the like. Also, in fast food establishments, there usually are napkin dispensers, catsup and mustard bottles, etc.

In an attempt to provide more table space for dining, some restaurants use smaller plates and dishes. However, in such situations, the plates and dishes may be overly full if normal portions of food are placed thereon. On the other hand, if the food portions are reduced in size, the patrons may complain.

The problem of adequate table space is particularly troublesome when the patrons are sharing a common serving dish or dishes. One example of such a situation is in establishments serving pizza. Ordinarily, the diners at one table will share a pizza of sufficient size to serve all of the individuals. If four or more persons are seated at a single table, a pizza to satisfy all of them will of necessity be quite large. Such a large pizza can take up considerable space on the table and leave little room for beverages and the standard articles and containers.

A further complication in providing sufficient table space for dining in pizza establishments is the handling of the seasoning and sauce containers. First of all, these containers must be arranged on the table away from the center of the table prior to the placement of the pizza on the table. Generally, the waiter or waitress must make a special trip to the table to position the stand containers so that there will be space for the main pizza platter. If they forget and do not do this advance work, then there is a scramble by the waiter balancing the pizza platter in one hand while he attempts to properly position the containers with the other. In the alternative, the patrons try to place the containers away from the center of the table as the waiter stands over them with the pizza in his hands. In any case, a great deal of confusion results.

Even after the pizza is placed on the table, there still may be some inconvenience. Usually, the seasoning containers are arranged around the pizza platter. This requires that each container be passed among the diners so that each can use what he wants. While this may be OK at the beginning of the meal, there must be additional passing of the containers each time one of the diners wishes a particular seasoning or sauce. This maneuvering can be a frustration for the patrons causing them to vow that they will not return to the establishment. If a sufficient number of patrons take this attitude, there can be a serious loss in revenue.

The present invention provides a novel tray assembly that simplifies serving of patrons at public dining establishments. The tray assembly of the invention provides a convenient means for placing a food tray or platter on a table. The tray assembly of the invention allows the food to be placed on the table for dining without moving the standard seasoning and sauce containers to provide space for the food. The tray assembly is particularly useful when serving foods such as pizza which may utilize common platters or dishes for all persons at a single table. In addition, the tray member of the tray assembly may be used for the preparation and cooking of the food as well as the serving thereof.

Another advantage of the novel tray assembly of the invention is the simplicity of its design. Also, the tray assembly can be fabricated from commercially available components and materials relatively inexpensively. In addition, the tray assembly can be installed easily both on new tables and also on tables now in use. Moreover, the tray assembly of the invention permits variations in the configuration of its components to meet specific requirements such as simplified stacking of the trays.

Other benefits and advantages of the novel tray assembly of the present invention will be apparent from the following description and the accompanying drawings in which.

Figure 1:
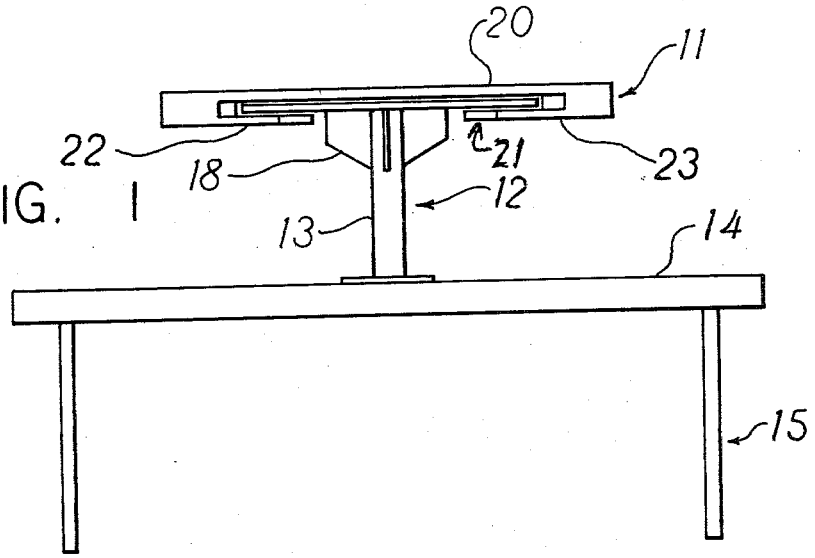
FIG. 1 is a side elevation of one form of the tray assembly of the invention.
Figure 2:
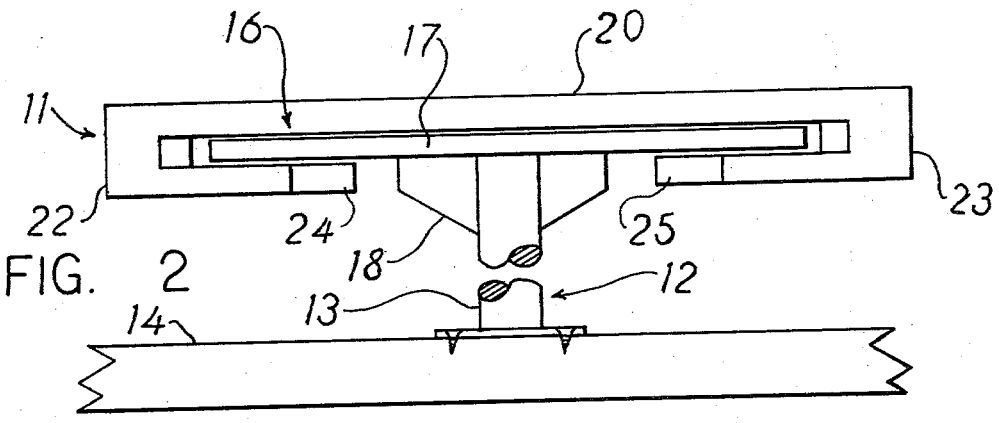
FIG. 2 is an enlarged fragmentary side view of the connection portion of the tray assembly shown in FIG. 1.
Figure 3:
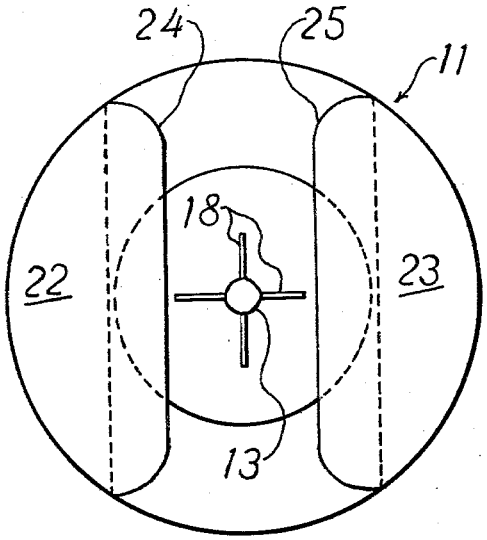
FIG. 3 is a bottom view of the tray assembly shown in FIG. 1.

As shown in FIGS. 1–3 of the drawings, one form of the novel tray assembly of the present invention includes a tray member 11 and a support member 12. Support member 12 includes a spacer portion 13 having one end affixed to a top 14 of a table 15 with suitable fasteners. The spacer portion extends upwardly from the table top 14.

A tray supporting portion 16 is located at the free upper end of the spacer portion 13. Advantageously, the tray supporting position 16 includes a horizontally disposed plate section 17 which preferably is in the shape of a disc as shown. If desired, the plate section 17 may be reinforced with brackets 18.

The tray member 11 includes a substantially flat tray or platter portion 20 and a support portion 21 associated with the bottom of the tray portion. The support portion 21 includes an open central section engageable with the tray supporting portion 16 of the support member 12.

As shown in FIGS. 1–3, the open central section advantageously is formed by a support portion including guide sections 22 and 23 having their adjacent edges 24 and 25 spaced an equal distance from the center of the tray member 11. The guide sections preferably are spaced from the bottom surface of the tray member 11 a distance sufficient to accept plate section 17 of the tray supporting portion 16 of the support member 12.

The adjacent edges 24 and 25 of the guide sections 22 and 23 advantageously diverge toward the opposide edges of the tray member 11. Preferably, the spacing between the edges 24 and 25 is substantially the same along the central portion with the spacing increasing toward the edges of the tray member 11.

Figure 4:
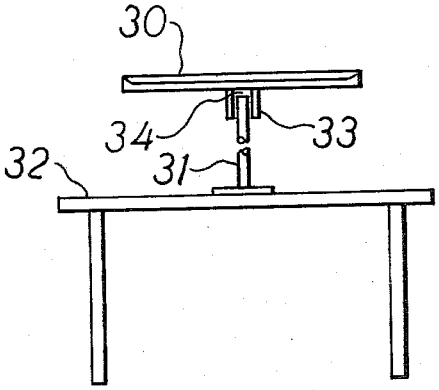
FIG. 4 is an exploded side elevation of another form of the tray assembly of the invention.

Another form of the tray assembly of the invention is shown in FIG. 4. The tray assembly includes a tray member 30 and a support member 31. The support member 31 is a round shaft which is affixed to a table top 32 and extends upwardly therefrom. The upper end of support member 31 is of a size to engage a support portion disposed on the bottom surface of the tray member 31.

The support portion of the tray member 31 as shown includes a cylindrical sleeve 33 affixed to the bottom of the tray member. The sleeve 33 has an open central section 34 of a size sufficient to engage the upper end of the support member 31 and thereby provide a rigid connection therebetween.

The tray assembly may be fabricated from a variety of materials. For example, one or more of the components may be fabricated from a metal such as steel, stainless steel, aluminum, etc. Also, the components can be formed of wood, plastic and the like. Advantageously, the tray member of the assembly may be fabricated of a material which allows it to be used not only for serving food but also for the preparation and cooking thereof. A metal is particularly useful in such situations.

In the use of the tray assembly shown in FIGS. 1–3, food such as a pizza may be prepared on tray member 11 and placed into an oven for baking. When the baking is finished, the tray member 11 is removed from the oven (not shown) and carried to a table of diners. The table 15 has a support member 12 affixed to the top 14 thereof. The tray member 11 with support portion 21 on the bottom thereof is posiitioned above and to the side of the support member 12. The tray member 11 is positioned so that the spacing between the bottom surface of tray portion 20 and the guide sections 22 and 23 is in the same horizontal plane as the plane of disc section 17 of the support member 12.

The tray member 11 is then moved toward the support member 12 so that the guide sections 22 and 23 engage the spacer portion 13 between the adjacent edges 24 and 25 of the guide sections. In this position, the disc section 17 is located between the bottom surface of the tray portion 20 and the upper surfaces of the guide sections 22 and 23. This orientation of the respective components provides a rigid connection between the tray member 11 and the support member 12 and thereby between the tray member 11 and the table 15.

Since the spacing between the guide sections 22 and 23 increases toward the opposite edges of the tray member 11, engaging the tray member with the support member is accomplished very simply. Furthermore, the height of the support member allows space under the tray member for the standard seasoning and sauce containers. Thus, the tray member can be positioned for convenient use by the diners seated around the table.

The tray member 11 can be rotated so that each diner has ready access to all parts of the tray surface. In addition, the tray member can be removed from the table by simply sliding the tray member horizontally away from the support member. Since the support portion of the tray member provides a relatively flat surface, the tray members can be stacked for storage in a minimum of space.

The tray assembly shown in FIG. 4 functions in a manner similar to the tray assembly illustrated in FIGS. 1–3, however the design of the connection between the tray member 30 and the support member 31 is more elementary. The cylindrical sleeve 33 affixed to the bottom of the tray member 30 is positioned above the upper end of the support member when food on the tray member is brought to the table. The tray member 30 then is lowered so the opening of the sleeve 33 engages the shaft of the support member 31. While such a connection provides some of the advantages of the tray assembly shown in FIGS. 1–3, the positioning of the tray member is not as simple and the tray members do not stack as conveniently. However, the tray assembly still does facilitate the serving of food and can be used conveniently by the diners without requiring the moving of the seasoning and sauce containers.

The above description and the accompanying drawings show that the present invention provides a novel tray assembly which is simple in design and convenient to use. The tray assembly of the invention can be installed easily both on new tables as they are being manufactured and also on tables that are already in service. Furthermore, the tray assembly makes the waiter's job easier and makes it more convenient for the diners being served. In addition, the tray assembly of the invention is especially useful when serving food such as pizza which may be served on a tray or platter that is common for all of the diners at one table. Also, the tray assembly may be used for the preparation and/or cooking of the food as well as the serving thereof.

It will be apparent that various modifications can be made in the particular tray assemblies described in detail above and shown in the drawings within the scope of the invention. For example, the size and configuration of the components may be different for the serving of specific foods. Also, the materials of which the tray assembly is fabricated may be changed to meet particular requirements. Therefore, the scope of the invention is to be limited only by the following claims.

What is claimed is:

1. A tray assembly including a tray member and a support member; the support member including a spacer portion having one end affixed to a top of a table and extending upwardly therefrom, and a tray supporting portion at the free upper end of said spacer portion including a horizontally disposed generally circular plate section; the tray member including a substantially flat upper tray portion, and a support portion associated with the bottom thereof, said support portion of said tray member including a pair of horizontally disposed guide sections having their adjacent edges spaced an equal distance from the center of said tray member and spaced from the bottom surface of said tray member a distance sufficient to accept said plate between said guide sections and said bottom surface to provide a rigid connection. therebetween with the spacing between the adjacent edges substantially the same along the central portion of said guide sections and with the spacing between the adjacent edges increasing toward the opposite edges of said tray member, said guide sections providing a substantially flat support portion for said tray member.

2. A tray assembly according to claim 1 wherein said spacer portion of said support member is of a substantially greater length than width.

* * * * *